US008777305B1

(12) United States Patent
Jannetides et al.

(10) Patent No.: US 8,777,305 B1
(45) Date of Patent: Jul. 15, 2014

(54) MULTIFUNCTION CHAIR CONVERTIBLE FROM OFFICE CHAIR TO FLOOR ROCKER AND STOOL

(75) Inventors: James N. Jannetides, Fishers, IN (US); Adam Anderson, Indianapolis, IN (US)

(73) Assignee: J Squared, Inc., Greenfield, TN (US)

( * ) Notice: Subject to any disclaimer, the term of this patent is extended or adjusted under 35 U.S.C. 154(b) by 2 days.

(21) Appl. No.: 13/349,556

(22) Filed: Jan. 12, 2012

(51) Int. Cl.
*A47C 13/00* (2006.01)
*A47C 3/02* (2006.01)
*A47C 7/00* (2006.01)

(52) U.S. Cl.
USPC ..... 297/118; 297/234; 297/236; 297/237; 297/258.1; 297/271.5; 297/271.6; 297/440.15; 297/440.22

(58) Field of Classification Search
USPC ..... 297/118, 234, 235, 236, 258.1, 271.5, 297/271.6, 440.15, 440.22, 237
See application file for complete search history.

(56) References Cited

U.S. PATENT DOCUMENTS 604,941 A * 5/1898 Paine ..... 297/132
677,383 A * 7/1901 Thompson ..... 297/132
682,961 A * 9/1901 Smith ..... 297/132
775,387 A * 11/1904 Thompson ..... 297/132
794,461 A * 7/1905 Mackey ..... 297/271.5 X
2,545,840 A 3/1951 Browne
D194,840 S 3/1963 Ridder et al.
3,269,771 A 8/1966 Erdos
D210,453 S 3/1968 Gardner
D217,089 S 4/1970 Julien
3,526,429 A 9/1970 Metzger
3,556,586 A * 1/1971 Beardmore ..... 297/118 X
3,821,825 A 7/1974 Bailey
D245,132 S 7/1977 Gale, Jr.
4,109,960 A 8/1978 Stinchfield
4,160,564 A 7/1979 Kyle
4,205,876 A * 6/1980 Cetina ..... 297/118
4,394,046 A 7/1983 Irwin et al.
D272,205 S 1/1984 De Boer
D273,729 S 5/1984 Pelly et al.
D283,858 S 5/1986 Opsvik
D286,802 S 11/1986 Ahlberg
4,697,845 A 10/1987 Kamman
4,736,982 A 4/1988 Hwang
4,765,684 A 8/1988 Kvalheim et al.
4,767,159 A 8/1988 Opsvik
4,767,160 A 8/1988 Mengshoel et al.
D297,690 S 9/1988 Opsvik
4,793,655 A 12/1988 Kvalheim (Continued)

OTHER PUBLICATIONS

Sauder Sales Literature, "Trey Multifunction Task Chair," © 2006 (2 pgs.).

(Continued)

*Primary Examiner* — Rodney B White
(74) *Attorney, Agent, or Firm* — William F. Bahret

(57) ABSTRACT

A multifunction chair with a floor rocker detachable from a base that is usable as a stool. The floor rocker and base are readily attached and detached by means of a quick-release mechanism having first and second couplers on the floor rocker and the seat plate of the base, respectively. The first coupler includes a rearward projection from a cross-member on the rocker and has left and right side latch mechanisms below the rear portion of the seat of the rocker, the latch mechanisms each having a laterally movable latch bolt. The second coupler is an integral part of the seat plate.

12 Claims, 16 Drawing Sheets

(56) References Cited

U.S. PATENT DOCUMENTS

| | | | | |
|---|---|---|---|---|
| 4,832,407 | A | 5/1989 | Serber | |
| 4,960,305 | A | 10/1990 | Opsvik | |
| D315,643 | S | 3/1991 | Guy | |
| 5,042,875 | A | 8/1991 | Biggs, Sr. | |
| 5,054,857 | A | 10/1991 | Kvalheim | |
| 5,074,621 | A * | 12/1991 | McDonald | 297/440.15 |
| D327,375 | S | 6/1992 | Cooper | |
| 5,169,210 | A | 12/1992 | Fricano | |
| 5,213,394 | A | 5/1993 | Tattrie | |
| 5,230,523 | A * | 7/1993 | Wilhelm | 297/440.15 X |
| 5,255,957 | A | 10/1993 | Opsvik et al. | |
| 5,261,727 | A | 11/1993 | Klaebel | |
| 5,308,146 | A | 5/1994 | Chou | |
| 5,423,597 | A | 6/1995 | Rogers | |
| D360,665 | S | 7/1995 | Hatfield | |
| 5,531,502 | A * | 7/1996 | Berggren | 297/271.5 X |
| 5,653,499 | A | 8/1997 | Goodall | |
| 5,667,278 | A | 9/1997 | Li | |
| 5,690,379 | A | 11/1997 | Cayssials | |
| D395,962 | S | 7/1998 | Buffon | |
| 5,806,922 | A | 9/1998 | Mendelovich | |
| D400,365 | S | 11/1998 | Rossi | |
| 5,865,508 | A * | 2/1999 | Martin | 297/440.15 X |
| D409,007 | S | 5/1999 | Osterweil-Glaz et al. | |
| D411,692 | S | 6/1999 | Ogg | |
| 6,000,750 | A * | 12/1999 | Rossman et al. | 297/118 X |
| D425,713 | S | 5/2000 | Tholkes et al. | |
| 6,116,682 | A | 9/2000 | Baur | |
| 6,132,342 | A * | 10/2000 | McKinney et al. | 297/258.1 X |
| D437,129 | S | 2/2001 | Pinto | |
| D437,692 | S | 2/2001 | Smith | |
| D439,066 | S | 3/2001 | Hannes et al. | |
| 6,345,864 | B1 | 2/2002 | Rivera et al. | |
| 6,352,306 | B1 | 3/2002 | Dreiling | |
| 6,367,874 | B2 | 4/2002 | Casini | |
| 6,416,123 | B1 | 7/2002 | Bell | |
| 6,422,654 | B1 * | 7/2002 | Grove | 297/440.15 X |
| 6,550,857 | B1 | 4/2003 | Canton | |
| 6,554,353 | B1 | 4/2003 | Yu | |
| 6,572,134 | B2 | 6/2003 | Barrett et al. | |
| D478,734 | S | 8/2003 | Chen | |
| D479,054 | S | 9/2003 | Chen | |
| 6,672,659 | B1 * | 1/2004 | Melohn et al. | 297/118 |
| 6,712,711 | B1 | 3/2004 | Skelton et al. | |
| D495,155 | S | 8/2004 | Baldanzi et al. | |
| 6,786,553 | B1 | 9/2004 | Grove | |
| D497,261 | S | 10/2004 | Epp et al. | |
| 6,824,149 | B1 | 11/2004 | Whitlock et al. | |
| 6,840,583 | B1 * | 1/2005 | Turner et al. | 297/236 X |
| 6,857,696 | B2 | 2/2005 | Usagani | |
| 6,953,222 | B2 | 10/2005 | Larrick et al. | |
| D515,831 | S | 2/2006 | Hosoe | |
| D516,828 | S | 3/2006 | Tsai | |
| D520,762 | S | 5/2006 | Pratt et al. | |
| D526,495 | S | 8/2006 | Albin | |
| 7,147,284 | B2 | 12/2006 | Mills et al. | |
| 7,152,358 | B1 | 12/2006 | LeAnna et al. | |
| 7,152,918 | B2 * | 12/2006 | Berkes | 297/118 X |
| 7,210,737 | B2 * | 5/2007 | Schaller | 297/170 |
| 7,316,452 | B2 | 1/2008 | Vestweber | |
| 7,338,122 | B2 | 3/2008 | Hei et al. | |
| D585,204 | S | 1/2009 | Wieland et al. | |
| 7,472,955 | B2 | 1/2009 | Crane et al. | |
| 7,472,959 | B1 * | 1/2009 | Ratza et al. | 297/440.15 X |
| D618,927 | S | 7/2010 | Zhang | |
| D639,576 | S | 6/2011 | Breen | |
| D641,983 | S | 7/2011 | Hazzard | |
| D650,604 | S | 12/2011 | Lee | |
| 8,083,288 | B1 | 12/2011 | Warncke et al. | |
| D658,904 | S | 5/2012 | Chen | |
| 8,585,136 | B2 * | 11/2013 | Warncke et al. | 297/118 X |
| 2002/0014792 | A1 | 2/2002 | Casini | |
| 2002/0074835 | A1 | 6/2002 | Chalender | |
| 2003/0218365 | A1 | 11/2003 | Kawiaka | |
| 2005/0002750 | A1 | 1/2005 | Vallance | |
| 2005/0040659 | A1 | 2/2005 | Baker et al. | |
| 2005/0057079 | A1 | 3/2005 | Lee | |
| 2006/0284463 | A1 | 12/2006 | Gelo et al. | |
| 2007/0110512 | A1 | 5/2007 | Brede et al. | |
| 2007/0131833 | A1 | 6/2007 | Maloney et al. | |

OTHER PUBLICATIONS

Kuchera, Ben, "The Transformer of Office Chairs: a Review of the Trey Chair," [online], Aug. 15, 2007. Retrieved from the Internet: http://arstechnica.com\reviews\other\the-transformer-of-office-chairs-a-review-of-the-trey-chairs.ars (8 pgs.).

* cited by examiner

MULTIFUNCTION CHAIR CONVERTIBLE FROM OFFICE CHAIR TO FLOOR ROCKER AND STOOL

BACKGROUND OF THE INVENTION

This invention relates to chairs and more particularly to dual-purpose chairs and other multi-purpose chairs, especially chairs which can be interchangeably used as an office chair or a recreational chair.

SUMMARY OF THE INVENTION

A multifunction chair with a floor rocker detachable from a base that is usable as a stool. The floor rocker and base are readily attached and detached by means of a quick-release mechanism having first and second couplers on the floor rocker and the seat plate of the base, respectively. The first coupler includes a rearward projection from a cross-member on the rocker and has left and right side latch mechanisms below the rear portion of the seat of the rocker, the latch mechanisms each having a laterally movable latch bolt. The second coupler is an integral part of the seat plate.

The objects and advantages of the present invention will be more apparent upon reading the following detailed description in conjunction with the accompanying drawings.

DESCRIPTION OF PREFERRED EMBODIMENTS

Figure 1:
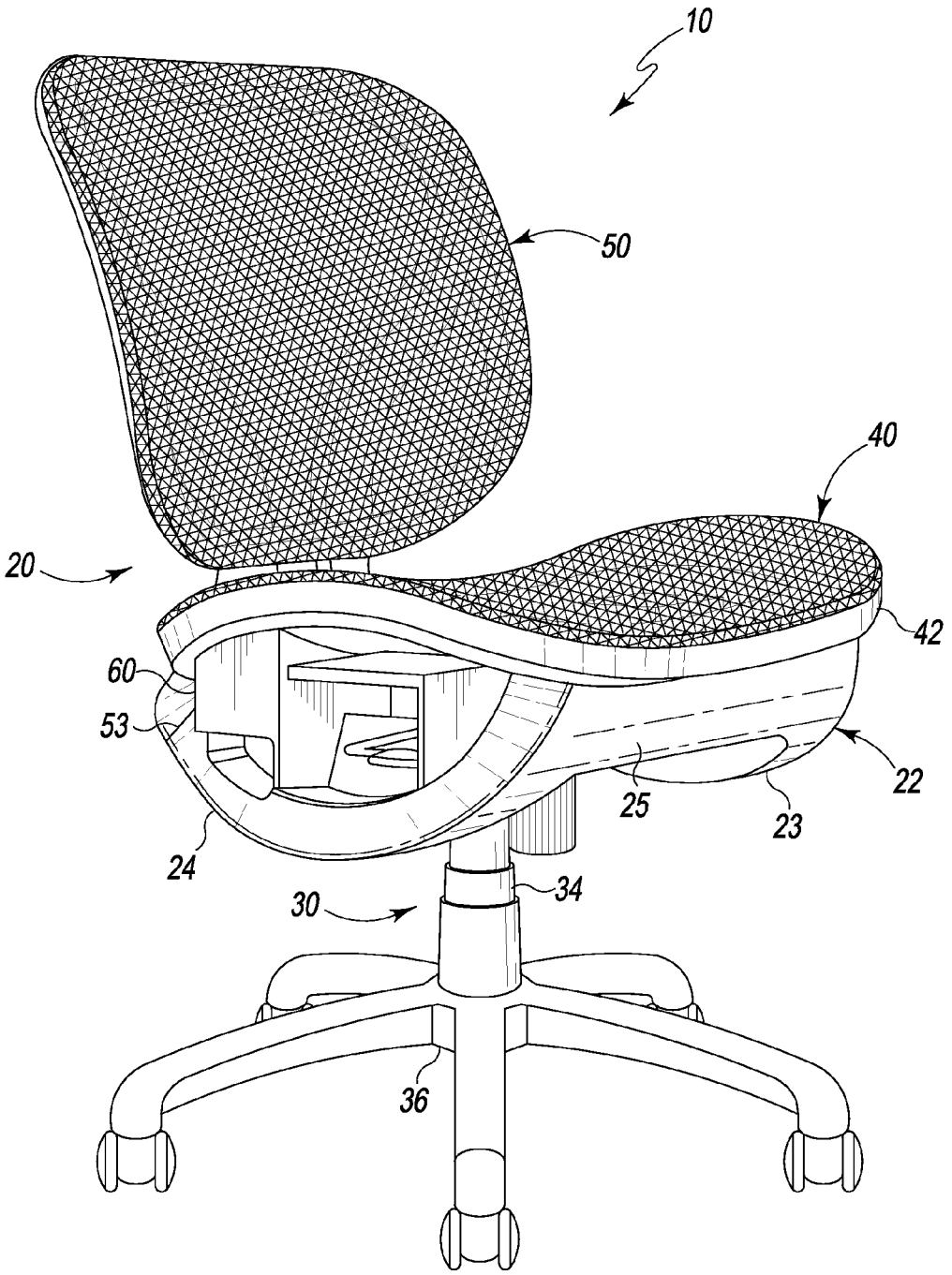
FIG. 1 is a perspective view of one embodiment of a multifunction chair with a floor rocker detachable from a base usable as a stool according to the present invention, with the chair shown in its office chair configuration.
Figure 2:
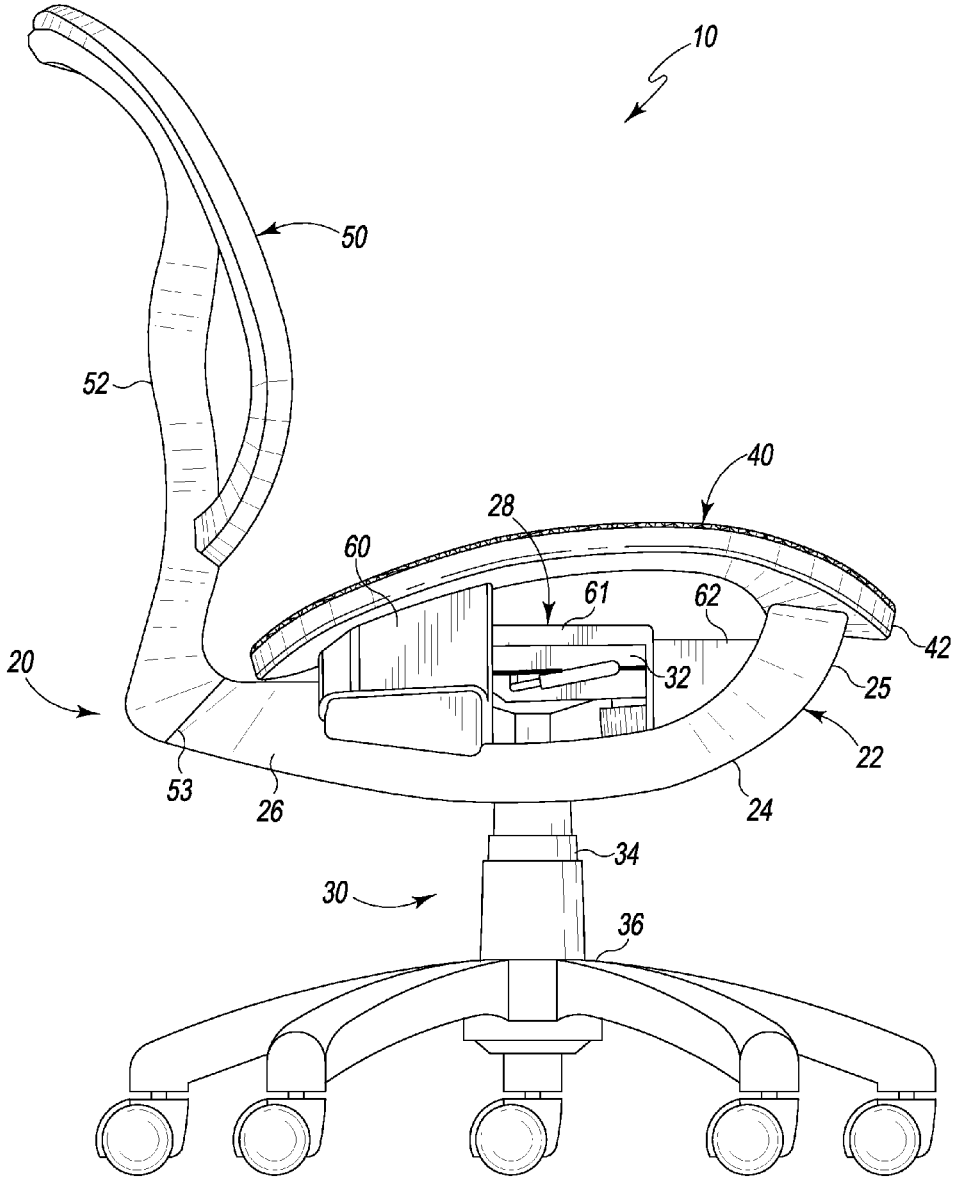
FIGS. 2 and 3 are right and left side views, respectively, of the chair of FIG. 1.
Figure 3:
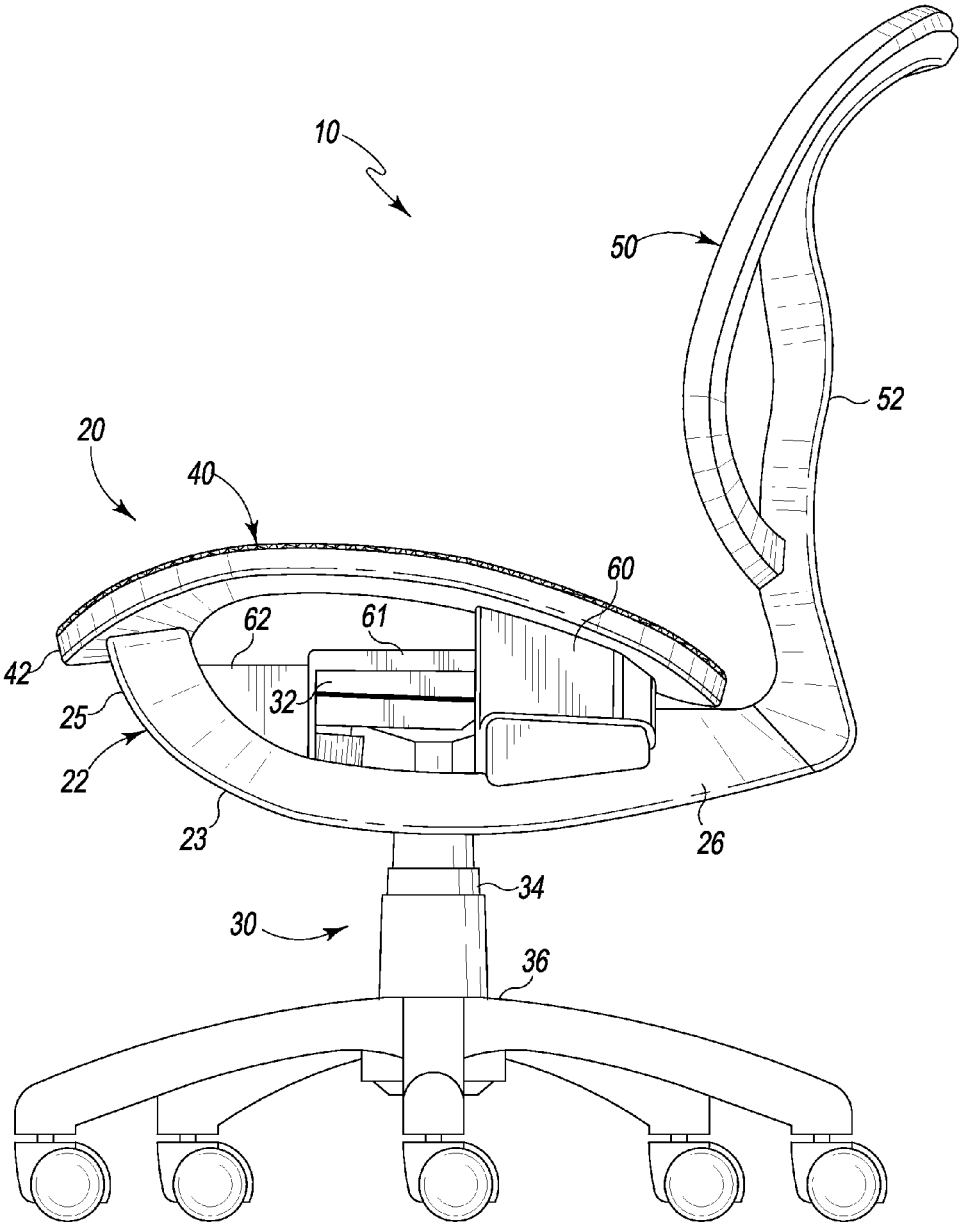
Figure 4:
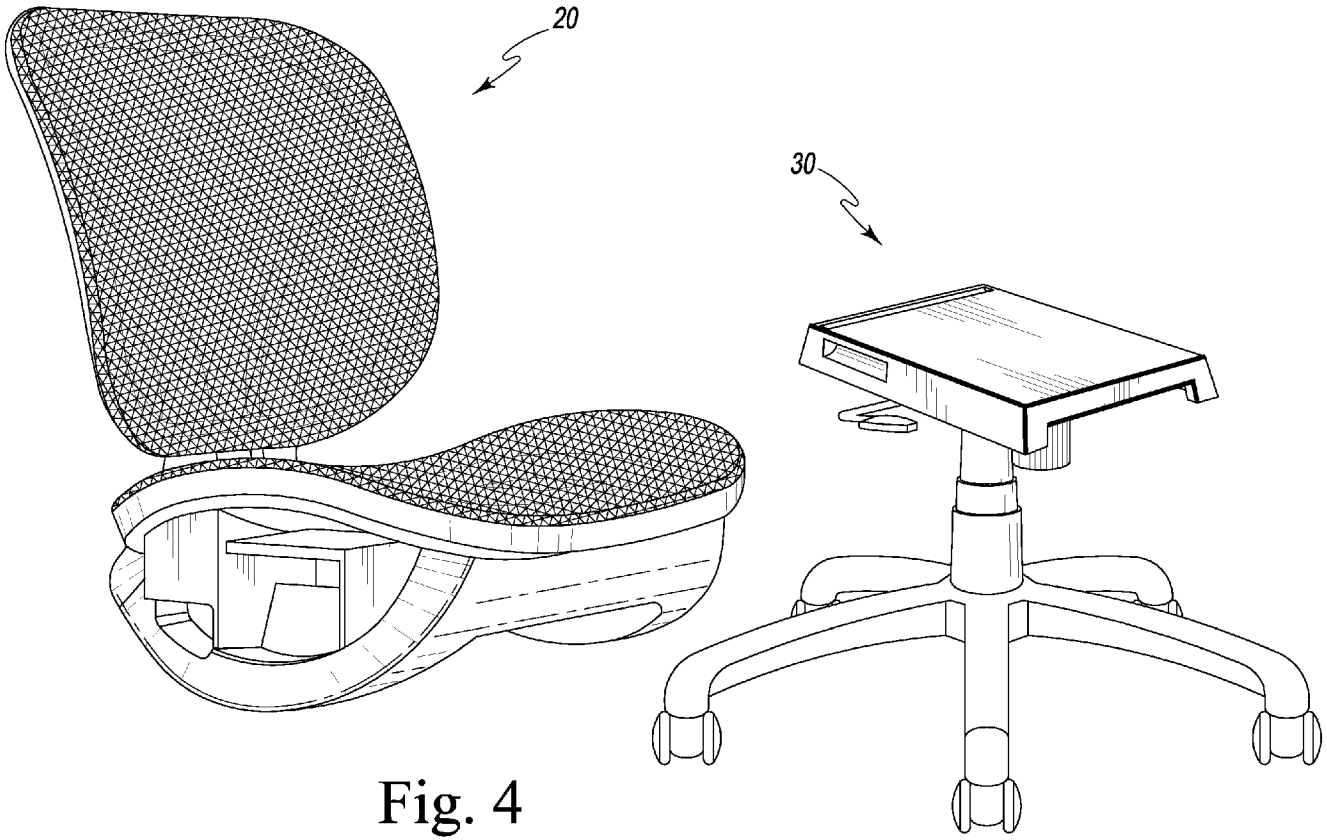
FIG. 4 is a perspective view of the floor rocker and stool of FIG. 1 uncoupled from each other.
Figure 5:
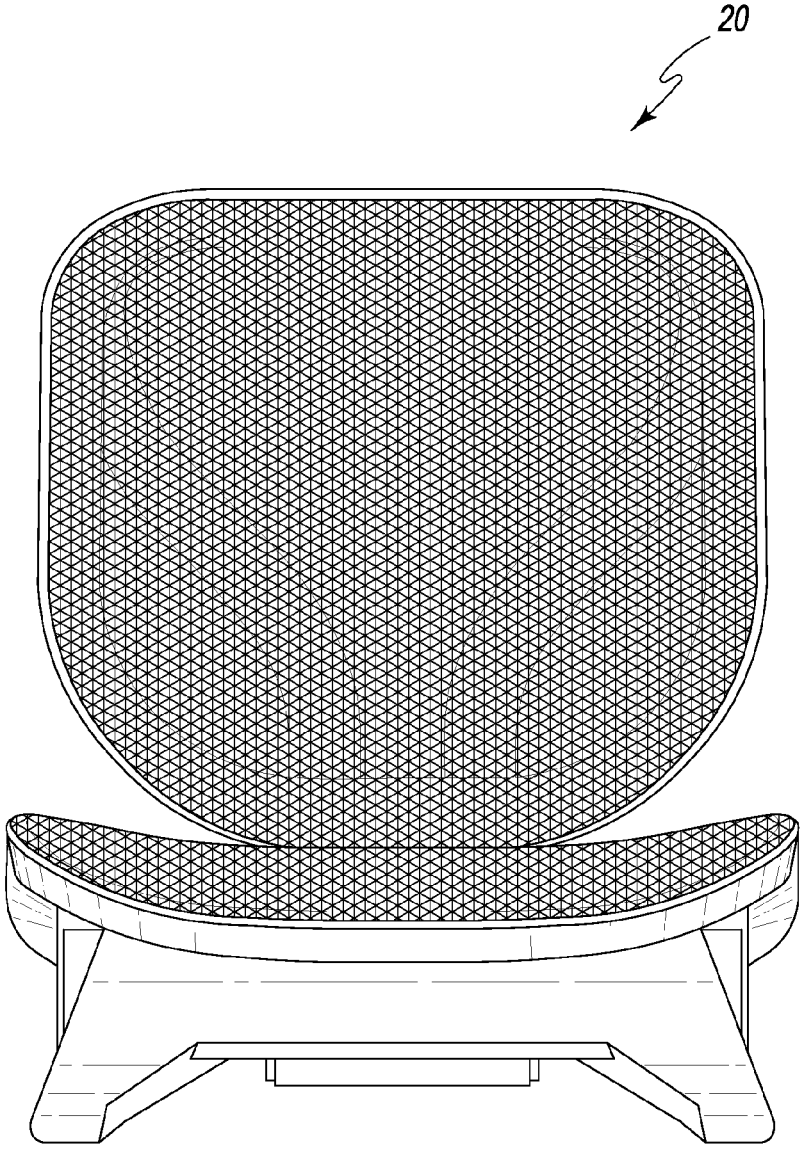
FIGS. 5 and 6 are front and rear views, respectively, of the floor rocker of FIG. 1 detached from the stool.
Figure 6:
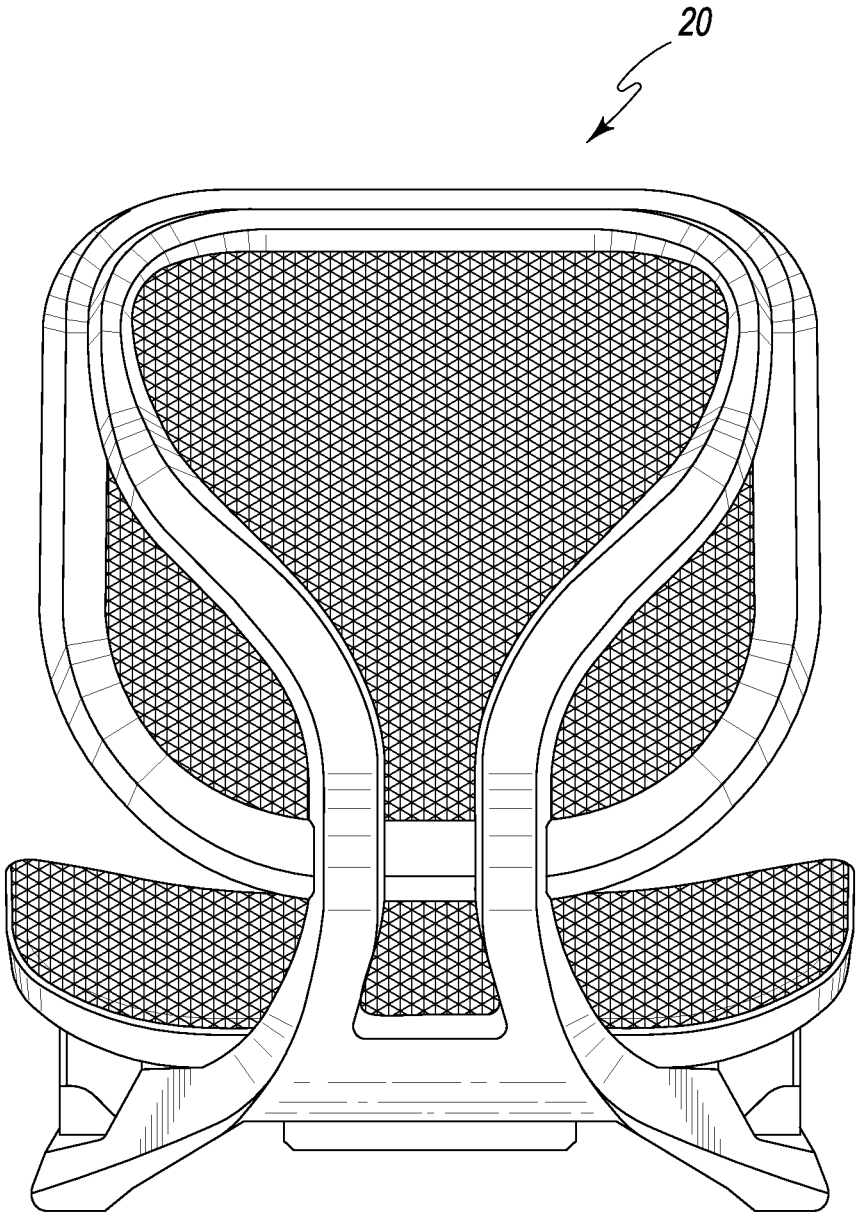
Figure 7:
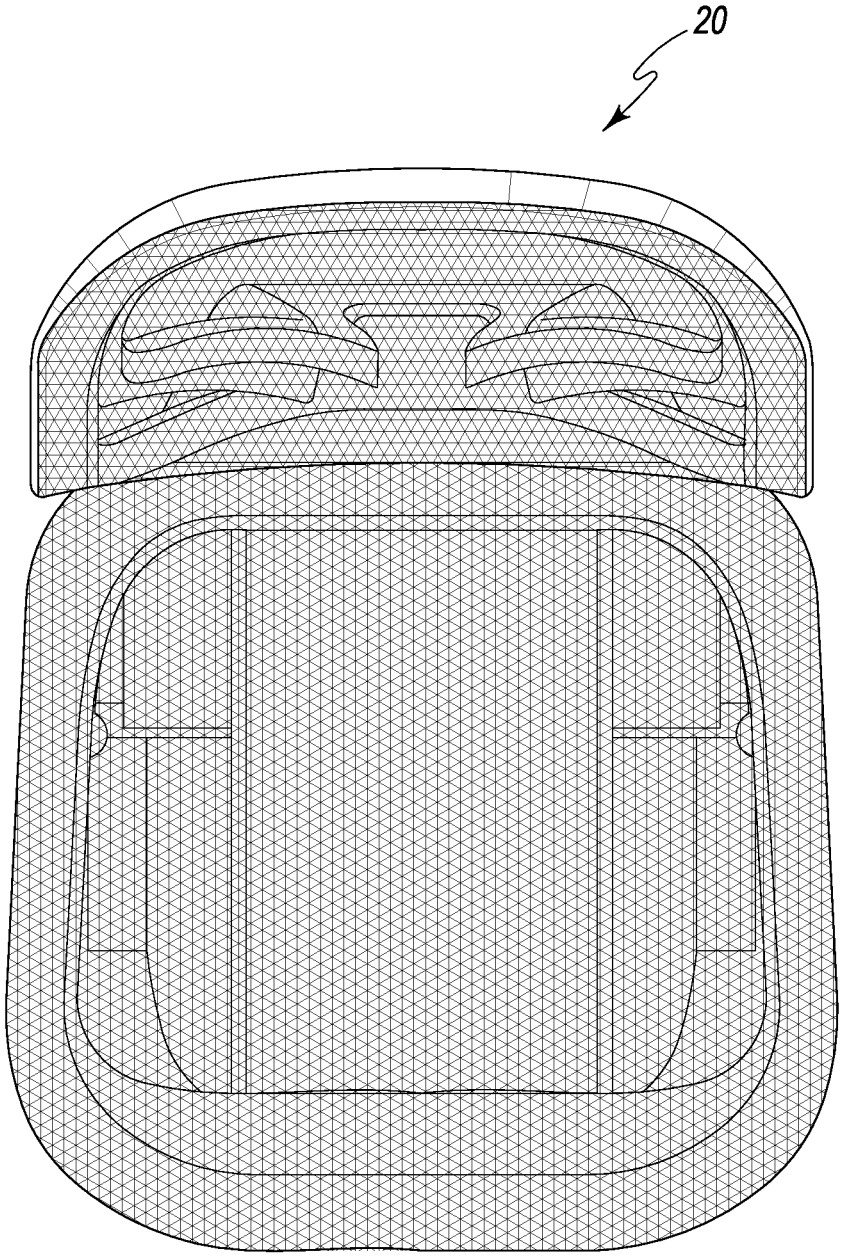
FIG. 7 is a top view of the floor rocker.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 is a perspective view of one embodiment of a multifunction chair 10 with a floor rocker 20 detachable from a base 30 usable as a stool according to the present invention, with chair 10 shown in its office chair configuration. Referring to FIGS. 1-9, 17 and 18, floor rocker 20 has a unitary main frame 22 which includes rocker rails 23 and 24, front & rear cross-members 25 and 26, and a frame 28 of a first coupler which is configured to mate with a second coupler on base 30 to form a quick-release mechanism for coupling the floor rocker to the base, as will be described. A contoured mesh seat 40 has its own seat frame 42 which is secured to frame 22 at the front end of each rail and at rear cross-member 26, and a contoured mesh seatback 50 is secured to frame 22 at rear cross-member 26. Base 30 includes a generally horizontal, rectangular plate 32 supported on a column 34 of a five-point star base 36 with caster wheels. Uncoupled from the floor rocker, the base can be used as a stool or a table.

The seat and seatback contain a breathable mesh which is virtually transparent, and the mesh may be independently supported in a first frame member which is fastened to a second frame member which is in turn fastened to the main frame of the floor rocker. Each frame member is substantially rigid and may be molded of hard plastic. Plastic resin materials including polypropylene, ABS, PET, nylon, and glass-filled nylons may be used. The seat and/or seatback may alternatively be upholstered. One-piece frames, including frames made of wood, metal or other materials, are also contemplated, as are seats and seatbacks having a rigid body-contact surface portion mounted on a frame. As shown in several drawings and particularly evident in FIG. 6, the seatback frame includes two curvilinear, vertically oriented frame members, or ribs, extending from the bottom end of the seatback in substantially parallel fashion then diverging toward the upper corners.

Figure 9:
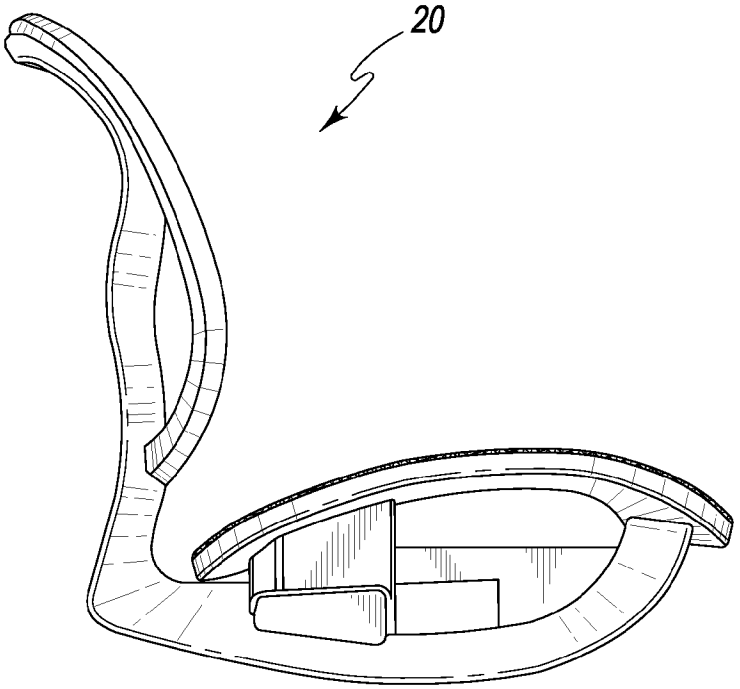
FIGS. 8 and 9 are left and right side views, respectively, of another embodiment of a floor rocker.
Figure 8:
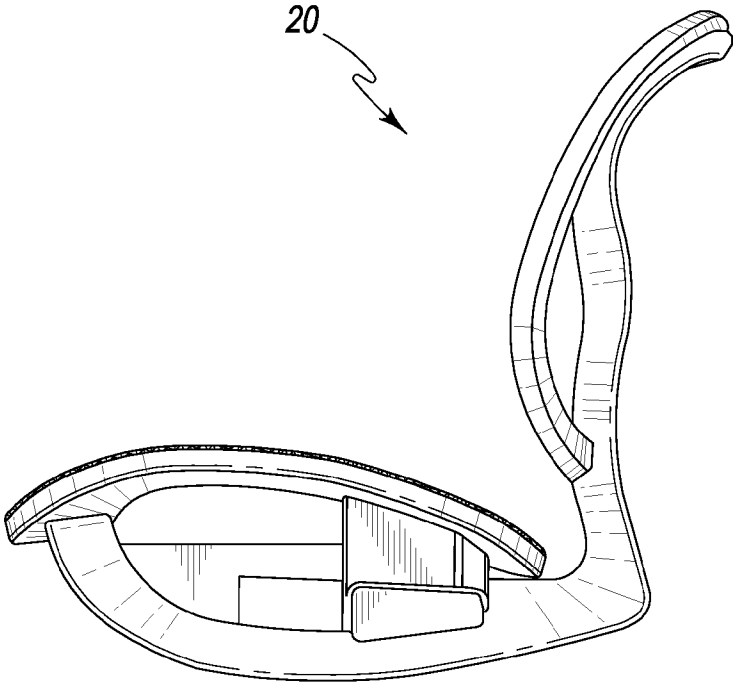

The main frame 22 of the floor rocker 20 is preferably molded as a single unit, preferably hard plastic. Plastic resin materials such as those indicated above may be used. The one-piece frame includes the rocker rails, front & rear cross-members, and frame 28 as described above. The front cross-member includes a rearward projection 82 which, along with frame 28, forms part of the first coupler, and frame 28 includes hollow columnar support structure 60 and may also include support structure 61, 62 or both. Each support structure 60 supports a side latch mechanism as will be described. Frame 28 also supports a central cap 80 of the quick-release coupler as will be described. Support 61 is an optional support for an armrest of the type having a rigid L-shaped support which includes a vertical member and a horizontal flange for attaching to a horizontal support surface such as on the top of support 61. FIGS. 8 and 9 are left and right side views, respectively, of an embodiment of a floor rocker which is the same as that described above except that it has no mount for an armrest.

Figure 10:
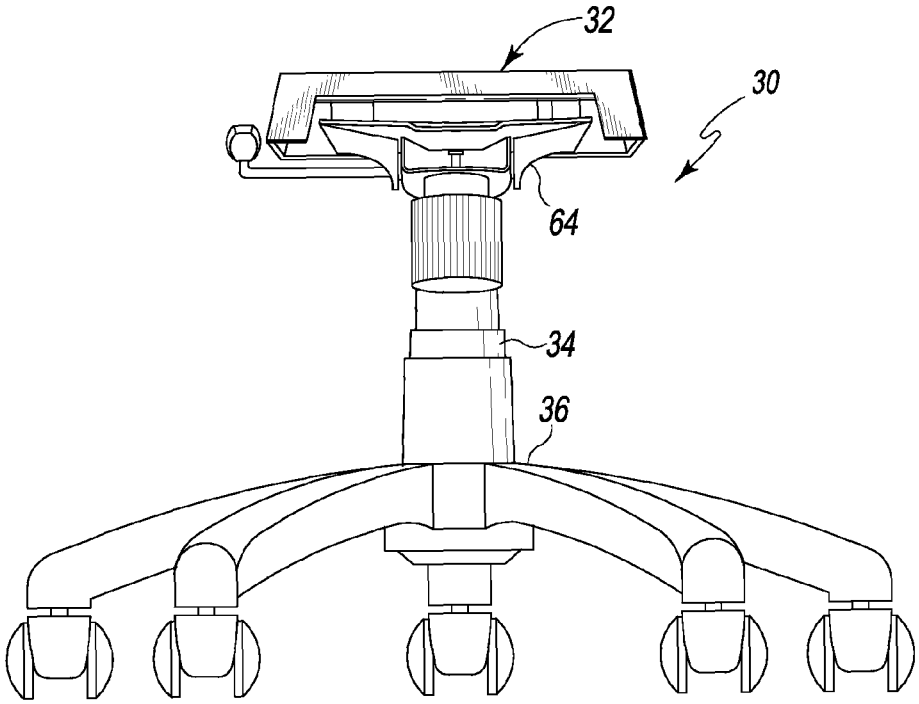
FIGS. 10 and 11 are front and left side views, respectively, of the stool of FIG. 1 detached from floor rocker.
Figure 11:
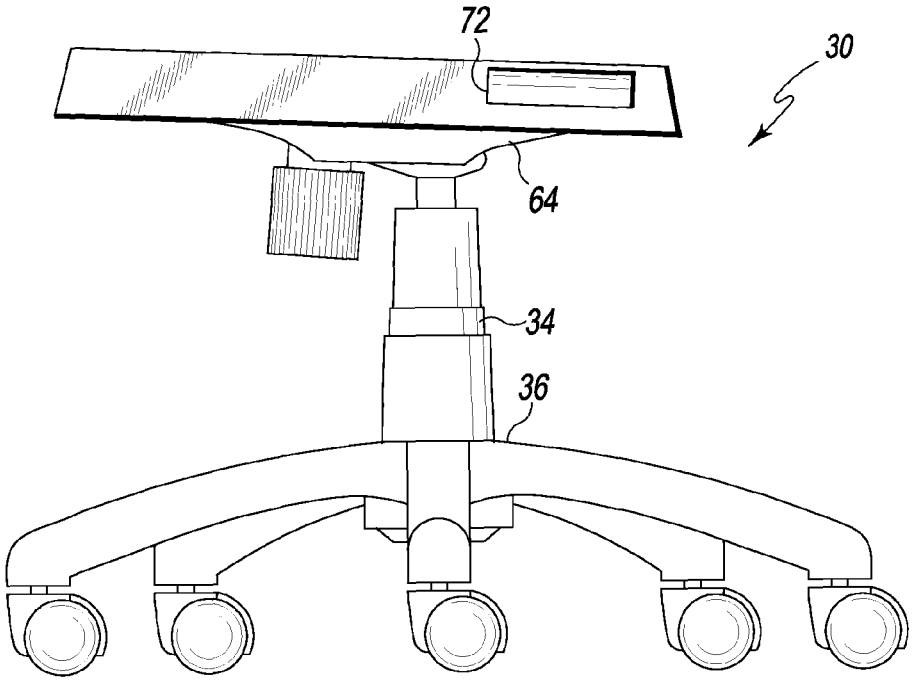
Figure 12:
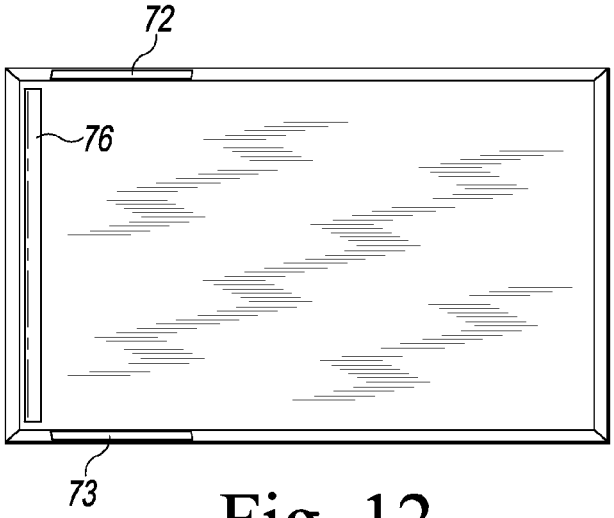
FIG. 12 is a top view of the stool seat.
Figure 13:
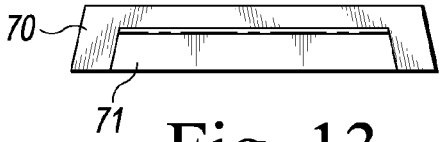
FIGS. 13 and 14 are front and rear views, respectively, of the stool seat.
Figure 14:
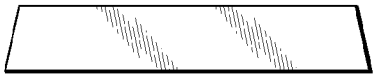
Figure 15:
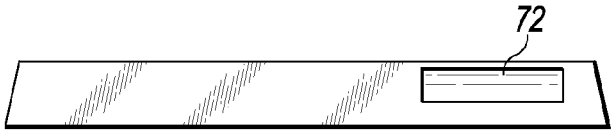
FIGS. 15 and 16 are left and right side views, respectively, of the stool seat.
Figure 16:
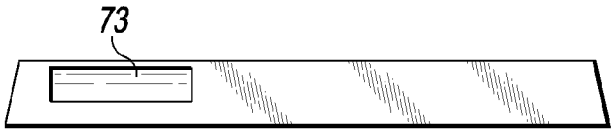

The base or stool 30 has seat plate 32 supported on a column 34 such as by means of a metal bracket shown in FIGS. 10 and 11. The column may be an adjustable-height column, e.g., a gas cylinder, with a height adjustment lever as shown. The seat plate has a front wall 70 with a laterally elongated opening or notch 71 in the bottom edge of the wall, and has left and right side openings or slots 72 and 72 which, together with notch 71, define a second quick-release coupler. Openings other than a notch are contemplated. For example, the openings or slots may be superficial, e.g., grooves, or may be through holes. The rearward projection 82 is configured to engage notch 71 when the front end of the floor rocker is placed over the seat plate. The seat plate may include a pencil groove 76 in its top wall 74.

Figure 18:
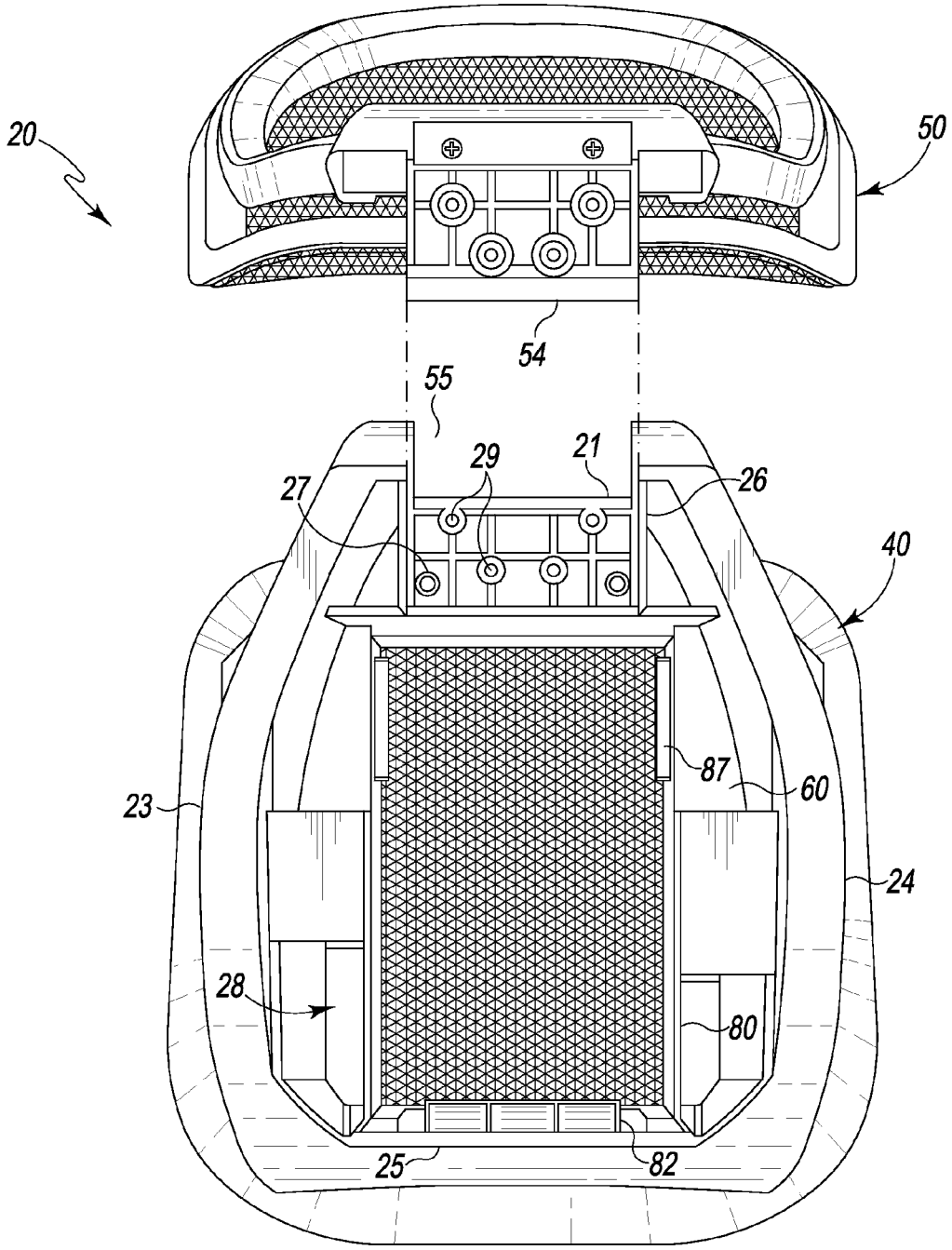
FIG. 18 is an exploded bottom view of the floor rocker showing the seatback separate from the seat.
Figure 19:
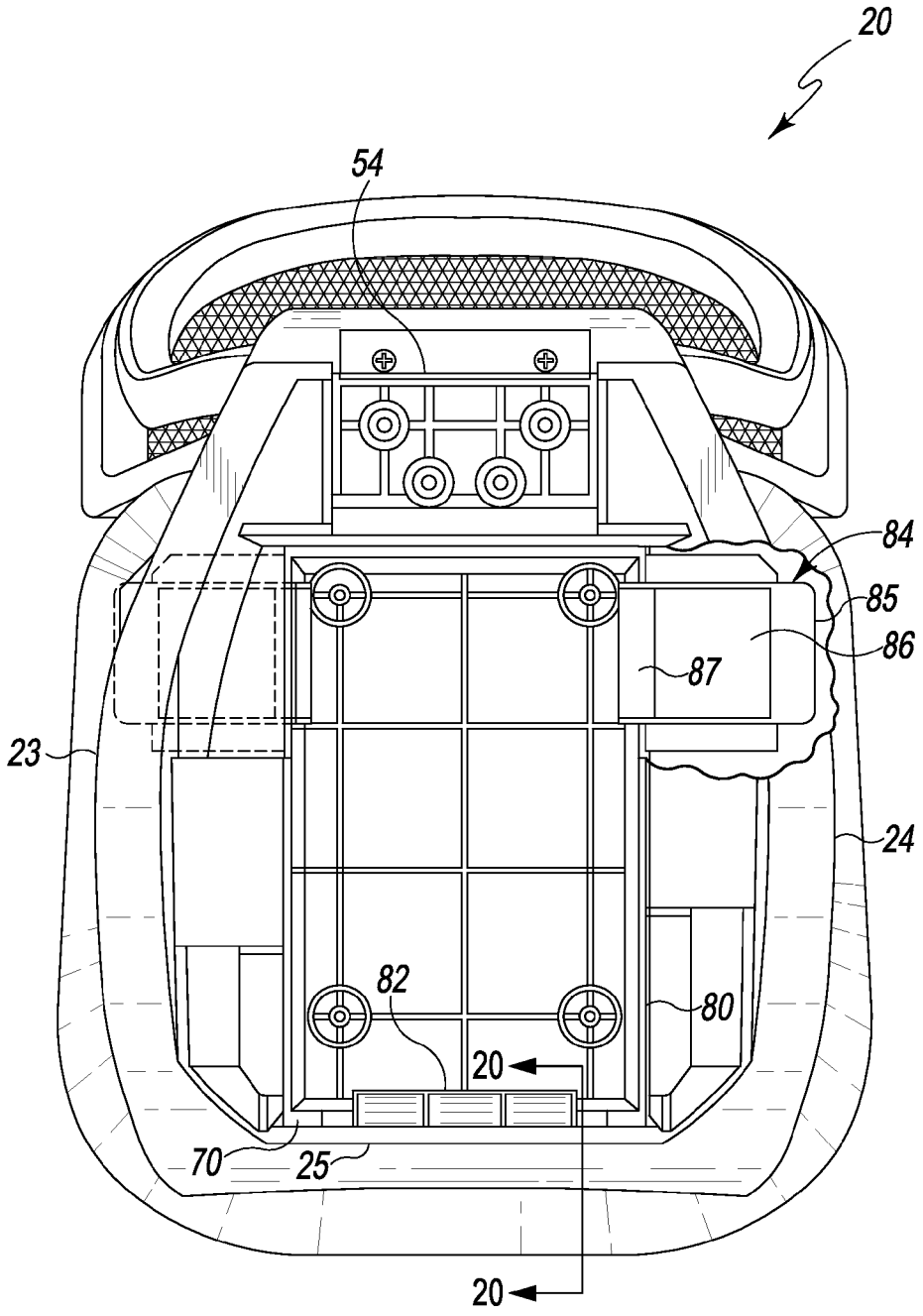
FIG. 19 is a bottom view of the chair with the base partially removed to illustrate the engagement of the stool seat to the underside of the floor rocker, with the rail frame cut away to show the right side latch mechanism.
Figure 20:
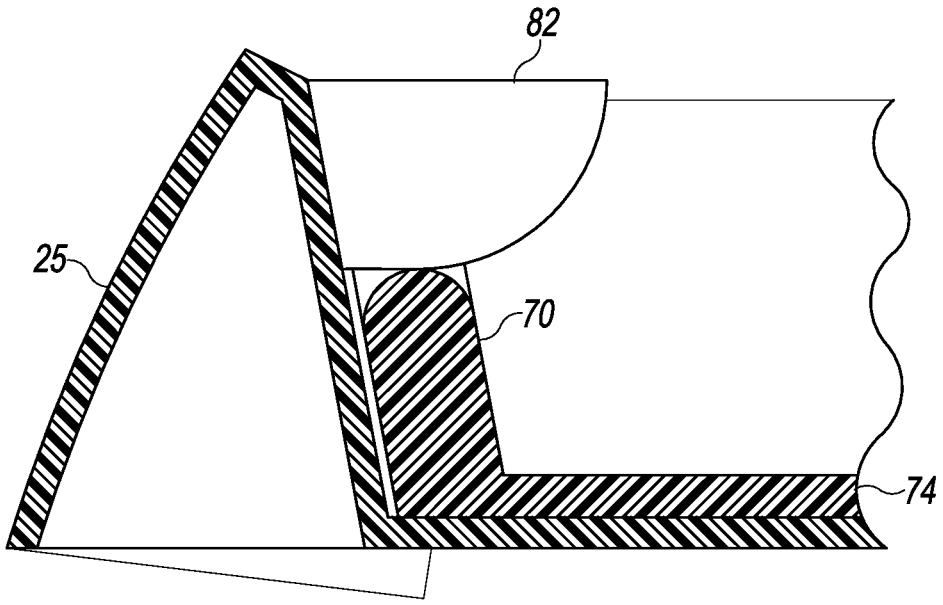
FIG. 20 is a longitudinal cross-section of the front latch mechanism taken along line 20-20 of FIG. 19, showing the quarter-round boss abutting the front end of the stool seat.
Figure 21:
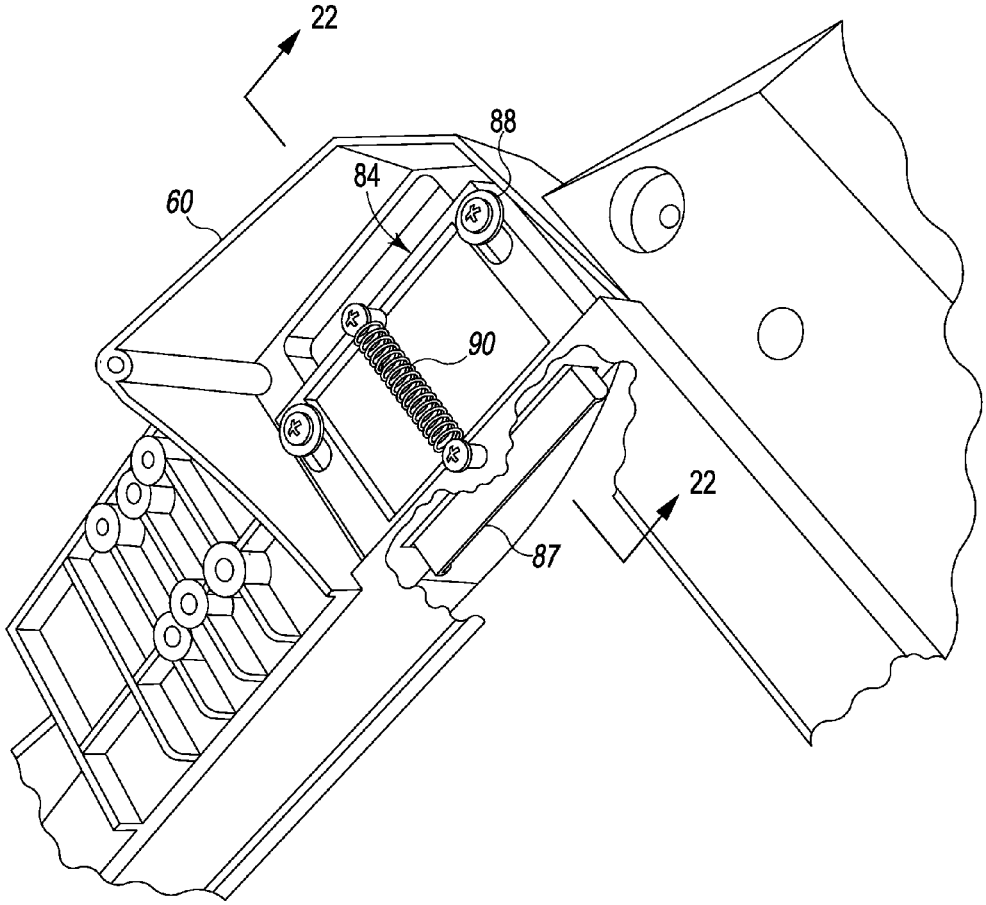
FIG. 21 is a perspective view of the right side latch mechanism, viewed from the upper left with the rail frame cut away to show the latch bolt thru the slot.
Figure 22:
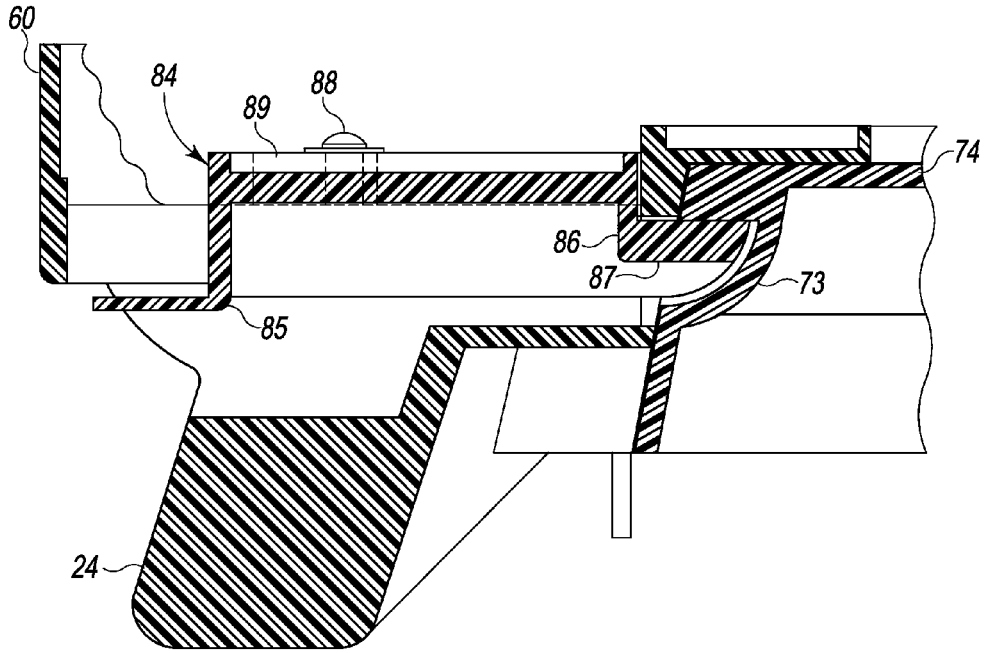
FIG. 22 is a transverse cross-section of the right side latch mechanism taken along line 22-22 of FIG. 21, looking toward the rear of the floor rocker.

As alluded to above, the chair includes a quick-release mechanism having first and second couplers on floor rocker 20 and seat plate 32, respectively. The first coupler may include a rearward projection such as laterally elongated boss 82 having a quarter-round shape as shown in FIGS. 18-20. The coupler may include a boss, flange, hook or tongue, among others. Left and right side recesses are provided in the rear half of the rail frame, e.g., in the lower portion of support structure 60, for access to spring-loaded latch handles 84 which are pulled to release the floor rocker from the stool. Referring also to FIGS. 21 and 22, each handle has a finger grip 85 on one side and a latch bolt 87 on the opposite side, and has a unitary construction, e.g., molded plastic. The handle includes a recess 86 in its bottom surface, and is restrained to lateral travel by a pair of guide posts 88 within slots 89 provided for this purpose. The handle is spring-biased toward its locking position, as illustrated, by a compression spring 90 connected between one post on the handle and another post secured to a fixed point on the frame.

The quick-release coupler on the underside of the floor rocker includes a rectangular cap 80 with sloped retaining walls as shown in FIG. 18, sized and shaped to nest with and securely retain seat plate 32 of the stool. FIG. 19 shows the plate within cap 80 and locked in place by the action of boss 82 snugly fitting within notch 71 and latch bolts 87 snugly fitting within slots 72 and 73. By means of the quick-release mechanism, the floor rocker can be readily attached to and detached from the base without tools.

Figure 17:
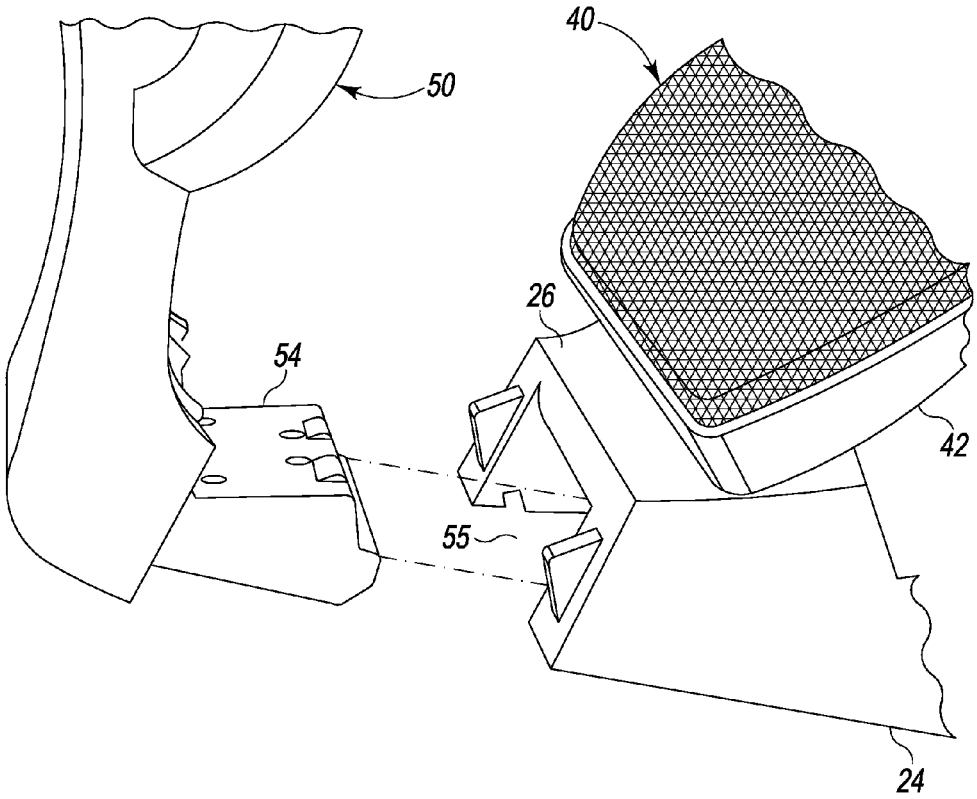
FIG. 17 is an exploded view of the floor rocker from the right side, showing the seatback detached from the rail subassembly.

Referring to FIGS. 17 and 18, the rear cross-member of frame 22 includes a bracket 21 having two holes 27 for attachment of the rear end of the seat frame. A screw or other threaded fastener is inserted from the underside through the holes into the seat frame. Bracket 21 has four holes 29 for attaching seatback. The bottom end of the seatback frame connects to the rear of the rear cross-member of frame 22 via a bracket 54 which fits into a bottom-side opening 55 in the cross-member and lies under complementary bracket 21 on the cross-member.

The rocker rails are advantageously shaped as shown in the drawings, which are drawn to scale. More specifically, FIGS. 2 and 3 have the same scale as each other. Likewise, FIGS. 5-7 have the same scale as each other. FIGS. 8 and 9 also have the same scale as each other, as do FIGS. 12-16, and likewise FIGS. 18 and 19.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. A multifunction chair convertible from an office chair to a floor rocker and stool, comprising:

a floor rocker having a first seat, a seatback, a pair of rocker rails in close proximity to said first seat, and a front cross-member below the front end of said seat;

a base having at least one vertical support member and a second seat mounted thereon, said second seat detachably connected to the underside of said floor rocker; and a quick-release mechanism having first and second couplers on said floor rocker and said second seat, respectively, said first coupler including a rearward projection from said cross-member and left and right side latch mechanisms below the rear portion of said first seat, said latch mechanisms each having a laterally movable latch bolt, said second coupler including a front portion and left and right side portions of said second seat in a spatial pattern corresponding to that of said rearward projection and left and right side latch bolts of said first coupler;

wherein said second seat is rectangular and has a top surface, a front wall, and left and right side walls, said second coupler including part of said front wall below said top surface and including part of the rear half of each of said side walls below said top surface;

wherein said front wall has a laterally elongated bottom edge notch and the rear half of each of said side walls has an opening therein; and wherein said quick-release mechanism is configured such that said rearward projection engages said notch and said latch bolts slidably engage said openings to lock said floor rocker on said second seat.

2. The multifunction chair of claim 1, wherein each said side wall opening is a longitudinal slot.

3. The multifunction chair of claim 2, wherein said floor rocker has a frame molded as a single unit including said rocker rails, front cross-member, rearward projection, a support for said latch bolts, and a rear cross-member; and wherein said first seat is secured to said frame at the front end of each rail and at said rear cross-member, and said seatback is secured to said frame at said rear cross-member.

4. A multifunction chair convertible from an office chair to a floor rocker and stool, comprising:

a floor rocker having a seat, a seatback, a pair of rocker rails depending from said seat, the seat width substantially exceeding the seat height above the bottom of said rails, and a front cross-member below the front end of said seat;

a base having a column and a seat plate mounted thereon, said seat plate detachably connected to the underside of said floor rocker; and a quick-release mechanism having first and second couplers on said floor rocker and said seat plate, respectively, said first coupler including a rearward projection from said cross-member and left and right side latch mechanisms below the rear portion of said seat, said latch mechanisms each having a laterally slidable latch bolt, said second coupler being an integral part of said seat plate.

5. The multifunction chair of claim 4, wherein said seat plate is rectangular and has a top surface, a front wall, and left and right side walls, said second coupler including part of said front wall below said top surface and including part of the rear half of each of said side walls below said top surface.

6. The multifunction chair of claim 5, wherein said front wall has a laterally elongated bottom edge notch and the rear half of each of said side walls has an opening therein; and wherein said quick-release mechanism is configured such that said rearward projection engages said notch and said latch bolts engage said openings to lock said floor rocker on said seat plate.

7. The multifunction chair of claim 6, wherein each said side wall opening is a longitudinal slot.

8. The multifunction chair of claim 7, wherein said floor rocker has a frame molded as a single unit including said rocker rails, front cross-member, rearward projection, a support for said latch bolts, and a rear cross-member; and wherein said seat is secured to said frame at the front end of each rail and at said rear cross-member, and said seatback is secured to said frame at said rear cross-member.

9. A multifunction chair convertible from an office chair to a floor rocker and stool, comprising:

a floor rocker having a first seat, a seatback, a pair of rocker rails in close proximity to said first seat, and a front cross-member below the front end of said seat;

a base having at least one vertical support member and a second seat mounted thereon, said second seat detachably connected to the underside of said floor rocker; and a quick-release mechanism having first and second couplers on said floor rocker and said second seat, respectively, said first coupler including a rearward projection from said cross-member and left and right side latch mechanisms below the rear portion of said first seat, said latch mechanisms each having a laterally movable latch bolt, said second coupler including a front portion and left and right side portions of said second seat in a spatial pattern corresponding to that of said rearward projection and left and right side latch bolts of said first coupler;

wherein said second seat is rectangular and has a top surface, a front wall, and left and right side walls, said second coupler including part of said front wall below said top surface and including part of the rear half of each of said side walls below said top surface;

wherein said first coupler on said floor rocker includes a rectangular cap with a plurality of downwardly extending retaining walls sized and shaped to nest with and retain said rectangular second seat.

10. The multifunction chair of claim 9, wherein each of said latch bolts has a length in the longitudinal direction which exceeds its lateral travel.

11. The multifunction chair of claim 10, wherein each latch bolt is integrally formed with a finger grip and an intermediate flat plate as a latch handle constrained to lateral travel; and wherein each latch handle is spring-loaded and biased toward a locking position in which its latch bolt engages a slot in a side wall of said second seat.

12. The multifunction chair of claim 11, wherein each latch handle is mounted such that its latch bolt extends through an opening in said retaining wall of said cap.

* * * * *